US012246372B2

(12) United States Patent
Crespo et al.

(10) Patent No.: US 12,246,372 B2
(45) Date of Patent: Mar. 11, 2025

(54) MANUAL TOOL FOR EXPANDING AND MANIPULATING STEEL CABLES

(71) Applicants: Hector Ceferino Crespo, Comodoro Rivadavia (AR); Jorge Ariel Gomez, Comodoro Rivadavia (AR)

(72) Inventors: Hector Ceferino Crespo, Comodoro Rivadavia (AR); Jorge Ariel Gomez, Comodoro Rivadavia (AR)

( * ) Notice: Subject to any disclaimer, the term of this patent is extended or adjusted under 35 U.S.C. 154(b) by 282 days.

(21) Appl. No.: 17/823,367

(22) Filed: Aug. 30, 2022

(65) Prior Publication Data

US 2024/0017318 A1 Jan. 18, 2024

(51) Int. Cl.
*B21F 1/00* (2006.01)

(52) U.S. Cl.
CPC ..... *B21F 1/002* (2013.01)

(58) Field of Classification Search
CPC . B21F 1/002; B25B 5/00; B25B 5/003; B25B 5/14; B25B 5/16; B25B 7/02; B25B 7/22; B25B 25/00; B25B 27/00
See application file for complete search history.

(56) References Cited

U.S. PATENT DOCUMENTS

| | | | | |
|---|---|---|---|---|
| 2,751,669 A * | 5/1956 | Crumpacker | ..... | B25B 5/14 269/47 |
| 5,531,141 A * | 7/1996 | Gilbert, Jr. | ..... | B25B 7/02 81/424.5 |
| 6,487,942 B1 * | 12/2002 | Carter | ..... | B25B 7/02 81/367 |
| 2003/0172782 A1 * | 9/2003 | Saunders | ..... | B25B 13/08 81/119 |

* cited by examiner

*Primary Examiner* — Robert J Scruggs
(74) *Attorney, Agent, or Firm* — Defillo & Associates, Inc.; Evelyn A. Defillo

(57) ABSTRACT

A manual tool for expanding and manipulating steel cables of the "clamp" type including two symmetrical flat steel pieces assembled with a bolt, each of which has a semicircular head with three equidistant perforations from which emerge three tubular extensions or cylinders perpendicular to the surface of the semicircular head, heads which in closed clamp position form a complete circle with six equidistant tubular projections and a central hole, both extending in their handles to open and close and to be able to expand and manipulate steel cables composed of a steel core and six strands of coiled metal wires that wrap said steel core, which cable will be provided with a chain sling with hook and a steel socket that has bronze wedges inserted for its adjustment.

4 Claims, 11 Drawing Sheets

Explanatory illustration A

Explanatory illustration B
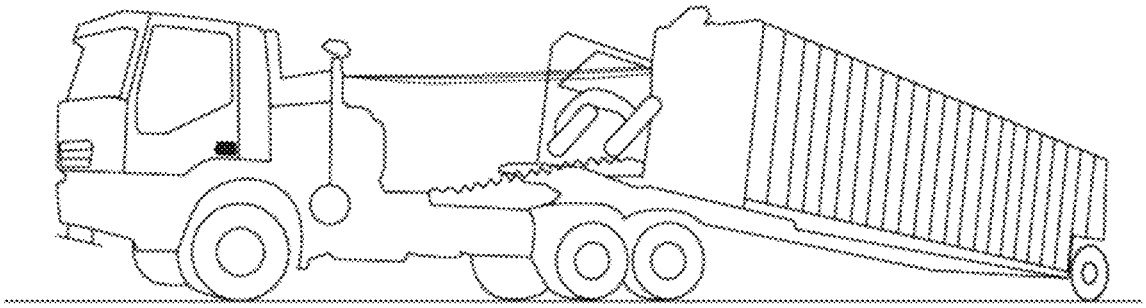
FIGURE 7 - Winch truck assembling the load
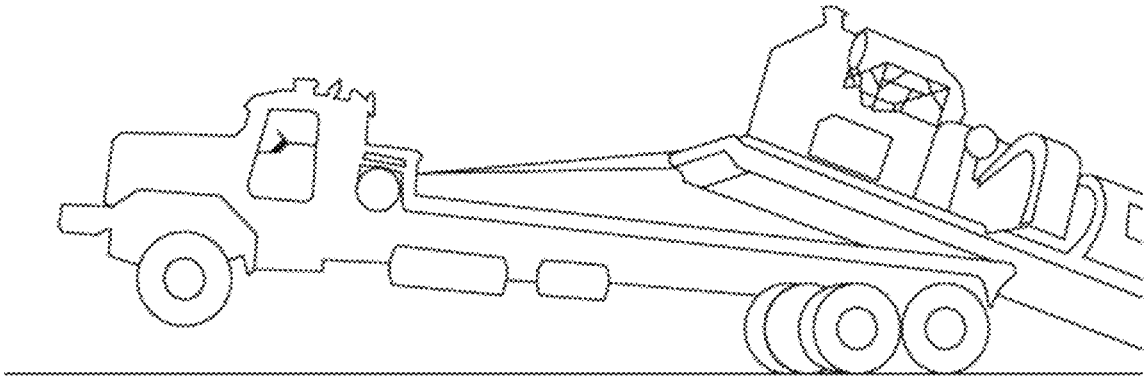
FIGURE 8 - Stress and force balance in the tension of the cable of the winch truck and the load.

Explanatory illustration C
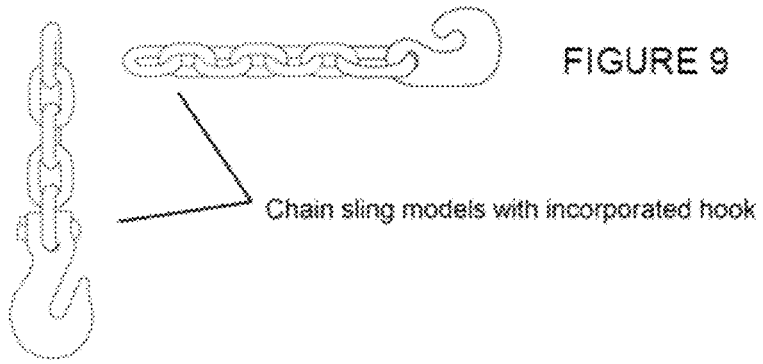
FIGURE 9
FIGURE 10
Assembled set of steel cable, socket (brake cylinder) and sling chain with hook
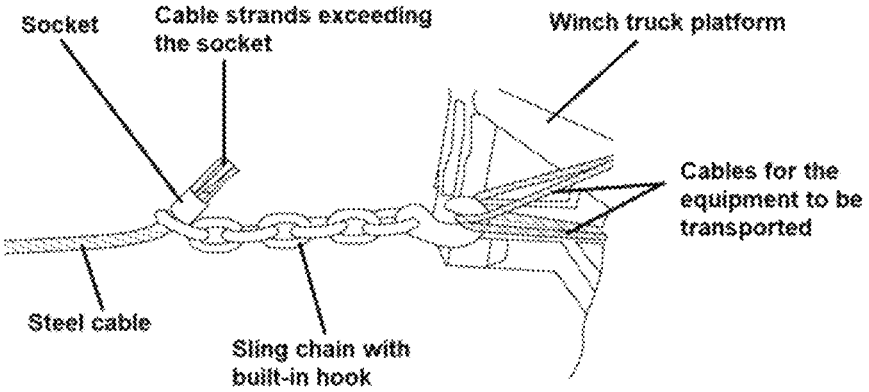
FIGURE 11
Examples of steel sockets and bronze wedges for steel cable coupling assembly
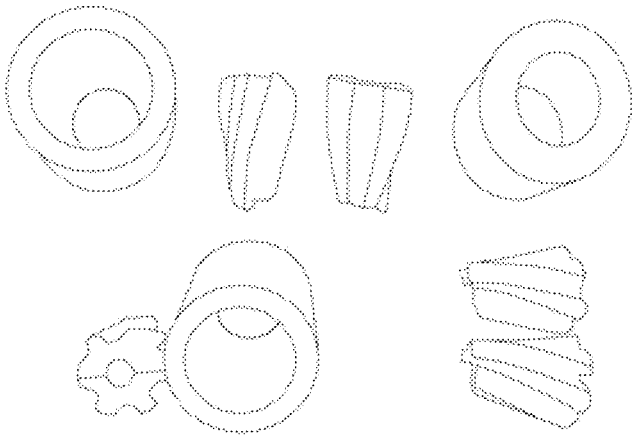

Explanatory illustration D

*EXAMPLES OF ASSEMBLY AND TENSIONING WITH SLING CHAINS AND SOCKETS*

First eyelet of the chain threaded into the cable by the socket

Another view of the first link locked in the socket and braked

The sling locked by the socket is aproaching the uphill roll to the winch truck

Explanatory illustration E

Examples of worn out and broken cables

Bending or crushing breakage

Wire cuts due to wear or corrosion

Cuts due to overstress and/or overload

Stages of assembly of a "coke" or irremediable curl

Other examples of deformation

Explanatory illustration F

FIGURE 18: Standard inspection form and warnings to workers in the area.

| Registration for inspection of steel cables, slings and sockets | | | | |
|---|---|---|---|---|
| Deputy management.....no. identification area/section.....steel cables, slings and sockets | | | | |
| Inspection performed by | Firm | | Inspection reviewed by | Firm |
| Checklist | | | Degree of attention (1=critical; 2=highly critical; 3=super critical) | |
| 1 | steel cables, slings and sockets | Degree of attention | situation detected; substandard condition | corrective measures |
| 1.1 | cut wires | | | |
| 1.2 | worn wires | | | |
| 1.3 | cable diameter measurement | | | |
| 1.4 | knots, distortion of wires and strands | | | |
| 1.5 | stretching or lengthening of the cable | | | |
| 1.6 | corrosion | | | |
| 1.7 | lack of lubrication | | | |
| 1.8 | fatigue, pitting of the wires; | | | |
| 1.9 | twist | | | |
| 1.10 | mechanical abuse | | | |
| 1.11 | strand loosening ("birdcage") | | | |
| 1.12 | core state of steel cable | | | |
| 1.13 | other conditions | | | |
| Observations: | | | | |
| Inspection date: | | Next inspection date: | | |
| Responsible | | Execution date | Follow-up (pending - in process – completed) | |
| | | | | |

FIGURE 19: Standard inspection form for cables and sling

| TASK: | Lifting tasks with winch | ATS N° | |
|---|---|---|---|
| Issue Date: | Review Date | Review | |
| Personal protective equipment: | Helmet, Gloves, Boots, Goggles | | |
| Observations | The type of load that will be hoisted and the capacity of the winch to be used must be taken into account. The winchman will maintain control of the sling and cable of his truck, determining the rejection and acceptance criteria according to its condition. | | |
| Successive steps of the task | Existing risks | Preventive controls | |
| 1. Supervisor designates load to winch | 1. Inadequate load for the capacity of the winch | 1. It must be taken into account what type of load will be hoisted, it will be designated according to the capacity of the winch. | |
| 2. Driver docks in front of the load | 2. Running over people, colliding with loads | 2. The assistant signaling should not be placed between the load and the truck; The driver must respect the assistant's signals. You must have the backup alarm. | |
| 3. Helper links sling to load skid. | 3. Hitting, squeezing, pinching, pricking fingers and hands with cables, overexertion | 3. Ask the winchman to release the cable to relieve tension, place the skid on one side at a time, do not drag your hands along the cable. | |
| 4. Driver unwinds and winds cable on winch | 4. Hitting people with cable when the sling is unlinked, deterioration of the cable, crushing of the cable, due to poor winding or malfunction of the winch lock | 4. Carry out the unwinding slowly without disconnecting from the load, personnel must leave the surroundings, check that the star is engaged correctly | |

MANUAL TOOL FOR EXPANDING AND MANIPULATING STEEL CABLES

FIELD OF TECHNOLOGY AND OF SPECIFIC APPLICATION

Apart from the five figures which are the specific drawings of this patent, six explanatory illustrations are added, named with the letters from A to F, which consist of infographs, photographs and images in order to illustrate the elements that are mentioned in the description and to make it easier to understand.

The field of technology we are concerned with here is "steel cables" work, and in particular we are referring to the work with "steel cables" in the oil industry.

BACKGROUND OF THE INVENTION

We call "steel cable" to a bundle of wires of metallic material, twisted (coiled) or in a flat structure, forming a single body of variable thickness, length and flexibility, with hooks, eyelets or rings at the ends, used for lifting or suspending weights. These cables, made of steel wires coiled into cylindrical structures or assemblies, also have a steel core (unlike other braided cables which have, for example, synthetic or fabric cores) and are standardized in their shape, type of winding and diameters.

Of all steel cables, we will deal here with those which consist of a steel core surrounded by six strands, themselves made up of coiled metal wires; the strands in the core envelope as a whole can be coiled in such a way as to describe a right-hand spiral (right-hand twist) or left-hand spiral (left-hand twist); and the component wires of the strands may be wound in the same direction as the strands (lang) or in the opposite direction (regular); the forms of twist depend on the manufacturer and user preference, and are adopted according to the type of work to be performed; the "regular" type is more stable and load-resistant than the "lang" type, while the "lang" type is more resistant to fatigue and abrasion. See Explanatory illustration A, examples a), b) and c).

As mentioned above, the steel cables described are constructed to precise standards according to the configuration of the strands; thus we have three general types of cables according to the nomenclature: 6×7 (six strands of seven wires each); 6×19 (six strands of nineteen wires each); and 6×36 (six strands of thirty-six wires each).

In the oil industry, these cables are used for lifting loads at the wellhead, and for loading and transporting machines, tools and accessories, such as pumping equipment, structures, pools, wellhead baskets, rods, all of which are heavy devices. To perform this task, the cables must be strong in themselves and their hooking and dragging elements must also have the appropriate shape and correct reinforcement to keep them firmly attached to the end of the cable so that they do not cut or come loose when the load is tensioned. See explanatory illustration B examples d) and e).

These cables are preferably fitted with a hitch assembly consisting of a chain sling, through the first link of which the cable passes and the last link of which carries the hook on which the loops of the load to be lifted and/or moved are hung; this sling is known in local jargon as a "fox tail"; then a device called a socket is fitted, which is a hollow steel cylinder with a conical interior, placed as a ring at the end of the cable, which acts as a two-way brake, braking the chain so that it does not come off the cable and braking the cable inside it so that it does not slip out of the position it has been given, The cable passes through the inside of this cylindrical device or socket, leaving a final emerging remainder, and two bronze wedges are inserted which imprison the strands against the inside wall of the cylinder to prevent the cable from slipping. See in explanatory illustration C, illustrations f), g) and h), the detail of the assembled cable and pulling the load that it carries towards the winch truck; examples of chain slings and socket and wedges; and in explanatory illustration D, illustrations i), j) and k), images of the position and tension between chain sling and socket in an assembled cable for the load.

This type of assembly is the one that in practice is the firmest and most preferred, and it promotes the abandonment of the previous widespread practice of forming a knot at the end of the cable, with preventive welds to avoid unknotting, from which knot the sling is then hung, causing serious deformations and cutting problems in the part of the cable that has undergone extreme bending to form the knot and/or where welds were made.

At present, cable suppliers deliver the cable in the size requested and without any kind of assembly; it will be up to the user to provide the construction described above, which currently has to be done manually without any tools suitable for the cable.

Difficulties of the Cable and Load Handling Trade

We must not overlook the description of the difficulties caused by the manual operation currently in use for the repair and replacement of the coupling assembly after the deterioration of the cables according to their construction and the stresses to which they have been subjected, suffering deformations (commonly called "cocas" or "biscuits"), crushing, stretching, un-twisting and partial cuts and even accidentally a total cut or a complete release of the socket brake due to being badly assembled.

All cables will initially stretch when load is applied and, as the cable deteriorates as a result of wear, fatigue, etc. (excluding accidental damage), continued handling will produce variations in the stretch, which will depend on the stretch versus time equation.

However, in addition to stretching, there are certain conditions that cause damage to steel cables, among which the following can be mentioned: overweight work for the size and type of cable, vibrations or shocks in the operation and handling of the load, external corrosion due to water or substances from the operating machinery and pitting of the metallic material, lack of adequate lubrication, abrasion due to friction, burning, electrical discharges on the cable, adhesion of foreign substances to the cable over time producing deformations, severe heat, changes in work (the cables "get used to" a certain type of work) and the use of a certain type of rope, severe heat, changes of work (the cables "get used" to one type of work and handling), operation of machinery, uneven winding on the reel, crushing, lack of lubrication, impact loads, back bending, material exhaustion (excessive service), inappropriate pulleys, incorrect work procedures, and—finally—accidental damage. See explanatory illustration E, illustrations l), m) and n).

For this reason, steel cables must be carefully and periodically inspected and subjected to "run and cut" programmes, i.e. the worn or damaged section is cut and the hooking system (chain-socket-wedge-sling-hook) is reassembled, for which no suitable tools existed before the proposed invention.

If such preventive inspections are not carried out, unexpected outages can lead to serious accidents with personal and material damage.

It is therefore necessary to have a suitable tool for handling the cables whenever the tasks required by the preventive checks have to be carried out, and also in extreme cases of unexpected breakage, a tool that should be easy to handle for the experience of the truck driver or auxiliary loading personnel.

SUMMARY OF THE INVENTION

It was mentioned that the type of hooking system previously in use, which provided a knot at the end of the cable to hold the hook to take the load, is progressively being abandoned; This knot, which was generally difficult to make and also difficult to hold firmly knotted due to the demands and the size of the steel cable, had to be made in favour of the twisting of the cable, which ended up producing a loosening of the cable, like a unravelling, to prevent this loosening, welding was carried out at different points, which also helped the deterioration of the cable. The permanence of this knotting technique is partly due to the difficulty of assembling the cable manually and without tools with socket and foxtail (chain sling).

It was stated that, in the transport of tower equipment, the cable of oil winch trucks is put under great strain by the inertia stress and weight of the equipment; but it will also suffer from friction as it passes over the end roller of the loading platform, and from the reduced size of the drum and the final reeling roller, as this device must take up as little space as possible on the chassis platform on which the load will be transported, and therefore the task of a neat and smooth reeling will require extra vigilance.

Taking into account what has been said so far: the tool will be indispensable in the event of accidental damage or abrupt cut in the field when working; it is ideal for facilitating the task in the normal cut and run operation, after the maintenance inspection of the cables, a task that will usually be carried out in the vicinity of a workshop or work counter; and, of course, it is extremely useful for the assembly of new cables.

It was mentioned above that the terminals supplying this type of cable do not provide the assembly of the coupling device, which does not prevent them from providing it in the near future if they incorporate the use of the invention disclosed here.

An additional piece of information that reveals the importance of the environment in which the present case is embedded: there is specific training for those who intend to drive and operate oil winch trucks, see for example the one offered by the Argentine Institute of Standardization and Certification (IRAM), whose information can be accessed at: https://www.iram.org.ar/curso/2086-operacion-de-camion-guinche-y-camion-petrolero/ where the operator is trained in the use of hoisting devices and in the factors that limit the load capacity, and helps him to acquire the theoretical knowledge to move and transport large packages, studying in detail the elements, accessories, tables, diagrams and safety standards used in the specialty.

There is also ample experience in the classification of personal accidents in the handling of these cables, for example: whiplashes and blows of cables when untying or pulling out of the sling against the people working on site; squeezes, pinches, punctures with cut wires, fingers or hands entrapment, with those who must handle the cables and load hook-ups; overstrains, hand injuries, cuts, injuries to the face and body, when the operators try to disassemble and/or assemble a new cable head . . . .

Cutting and moving of cable work and assembling the whole hitch to the present day If the inspection of the cable shows that there are visible deterioration conditions, such as loss of more than 5% of the diameter due to stretching, broken wires from the strand, excessive corrosion and close to produce surprise cuts, the damaged section should be cut, normally to ensure that it is already in a healthy section without any doubt, moving the coupling device as much as necessary, eliminating the section of the cable in bad condition.

To date, the inventors—experienced oilfield workers and especially those involved in loading and transporting machinery and equipment—know no other way of working than by hand, and with the "skills" acquired by every truck driver or mechanic of good will. Tool bench, vise, cutting pliers, ground and bolt cutters are the common tools, and the strength of the hands to cut, disassemble the hitch assembly of the discarded part, and reassemble it on the healthy cable.

It should be noted that used cable is much more difficult to handle than new cable, since the stretching, twisting and rigidity it acquires with the demands of the use to which it has been subjected and the aging process make it less malleable for manual work and rougher to the touch, to the point of being risky to operate without adequate protection for the hands and face. See explanatory illustration F with the table of labor warnings and inspection of materials, figures o) and p), both typical for this purpose.

Once the cable has been cut, an attempt will be made to recover the undamaged parts to be incorporated in the new assembly, namely: the chain sling with its hook and the steel collar or "socket" to prevent displacement of the cable; and the used wedges (which will surely have been deformed and/or worn out) will be replaced by two new bronze wedges to lock the strands inside the socket and prevent their displacement.

After cutting the discarded part of the cable, the new end of the steel cable must be mounted in a counter vise or in a mobile fastener in case it is in the working field, insert the first link of the sling chain in the cable or—in other words—thread the cable in the first link of the chain, then pass the cable inside the cylindrical steel tube with conical socket interior, letting it show through the other end of the socket, and then hold the end of the cable and open it separating the strands to let the two bronze wedges that will adjust the strands against the circular wall of the socket to prevent the cable from slipping, these wedges are placed manually and manipulated until their positioning is even, avoiding that they are at different heights from each other, making sure that their positioning is symmetrical; Finally, the strands should be closed as much as possible and the socket should be pushed towards the end of the cable until it can no longer move, the assembly having been conveniently locked.

It can be easily deduced that performing this task manually and as it has been done, requires a lot of effort and proven experience; the risks of this task have already been mentioned as they affect the operator; but it is worth mentioning another detriment: the inappropriate assembly of the cable and its coupling accessories will result in economic losses and work time much more important than the cost of the tool.

In other words, anticipating what follows: the incorporation of this tool in practice will: facilitate the work by reducing assembly time and costs, reduce the risk of accidents due to misassembly of the cables and reduce future mishaps and accidental and serious economic losses.

BRIEF DESCRIPTION OF THE FIGURES

Figures of the invention are provided, the first four corresponding to the "clamp" mode with its different views, and a last figure intended to show the "fixed key" mode. In both cases the identical references have been maintained for those parts that coincide, so that in the description that follows we can distinguish them in each option without inconvenience.

FIG. 4: shows an example of a "fixed wrench" type resolution in front perspective;

FIG. 7 an explanatory illustration B showing a winch truck assembling the load.

FIG. 8 shows a tress and force balance in the tension of the cable of the winch truck and the load.

FIG. 9 show an explanatory illustration C showing a chain sling model with incorporated hook.

FIG. 10 shows an assembled set of steel cables, socket and sling chain with hook.

FIG. 11 shows examples of steel sockets and bronze wedges for steel cable coupling assembly.

FIG. 18 shows an explanatory illustration F a standard inspection form and warnings to workers in the area.

FIG. 19 shows a standard inspection form for cables and sling.

DESCRIPTION OF THE INVENTION

Figure 1:
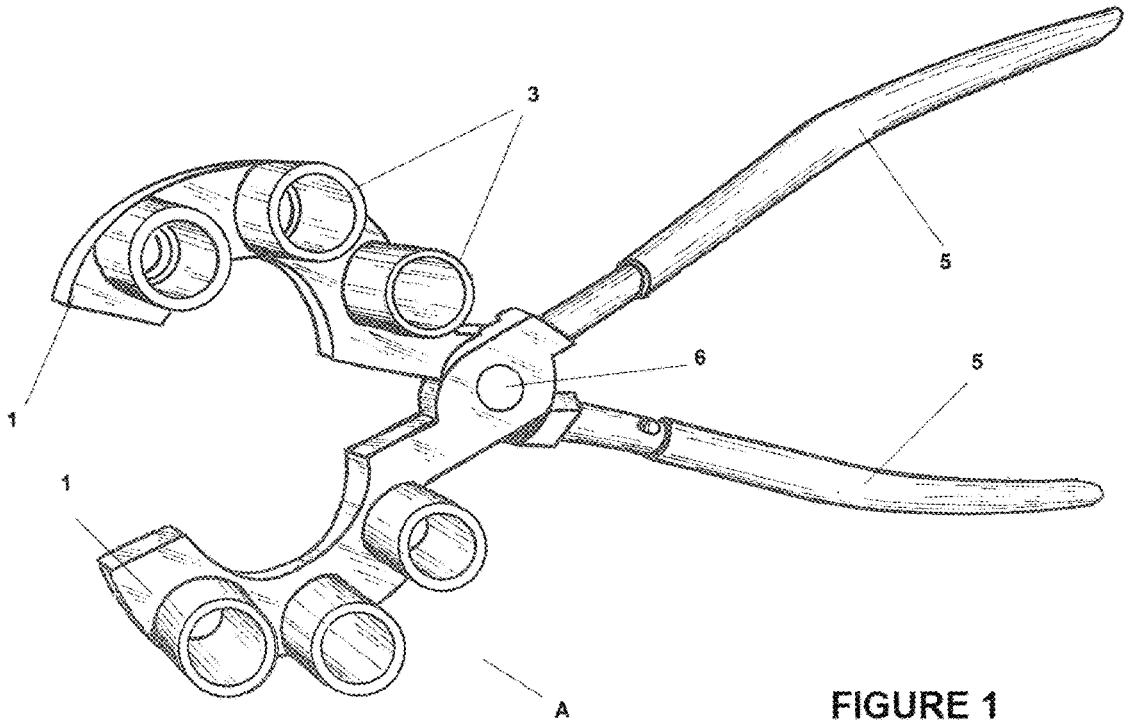
FIG. 1: shows the tool in a frontal perspective and in an open position.
Figure 2:
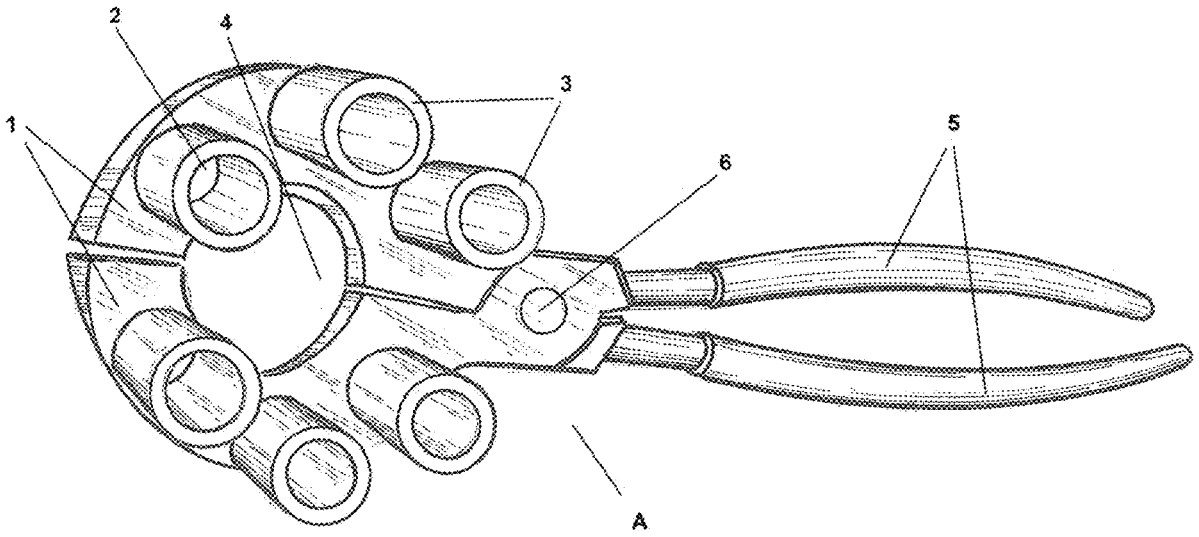
FIG. 2: shows the tool in the same front and closed perspective.
Figure 3:
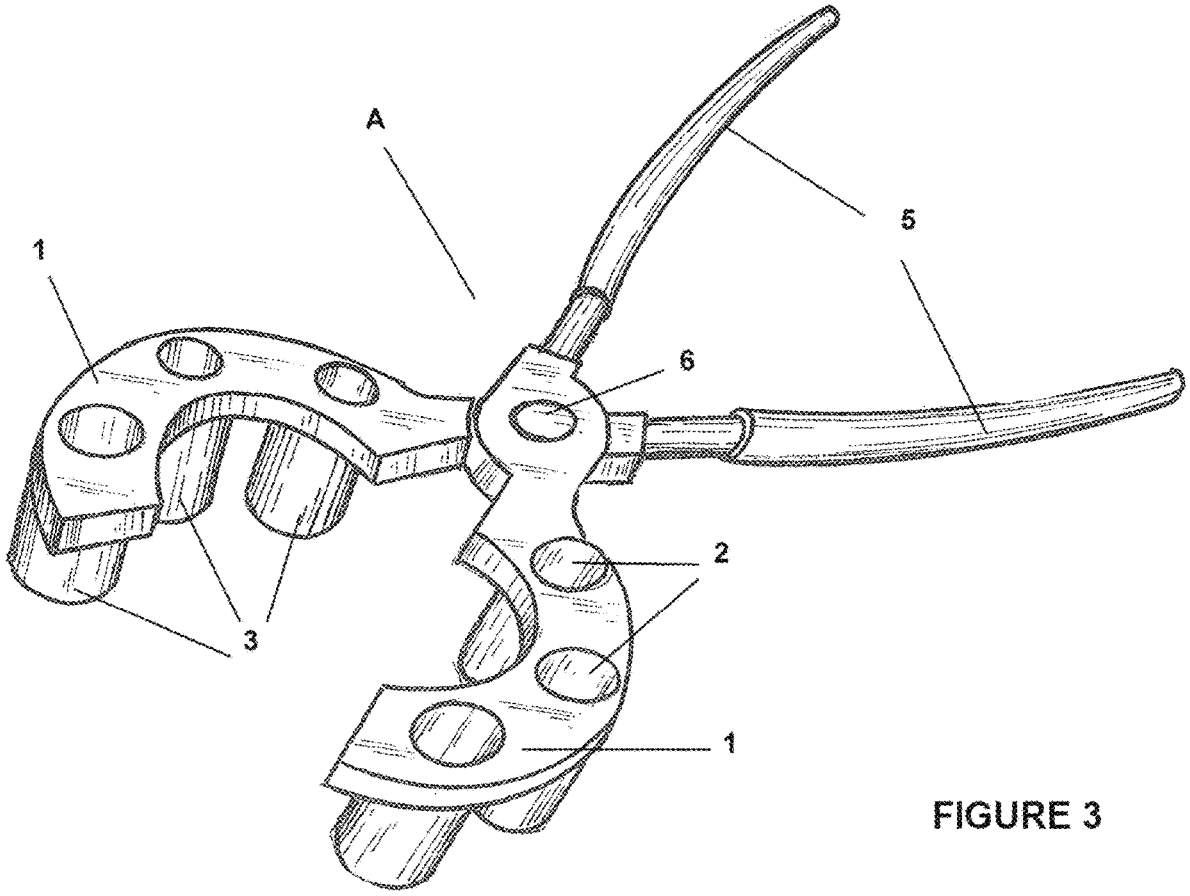
FIG. 3: shows the tool in rear and open view.
Figure 4:
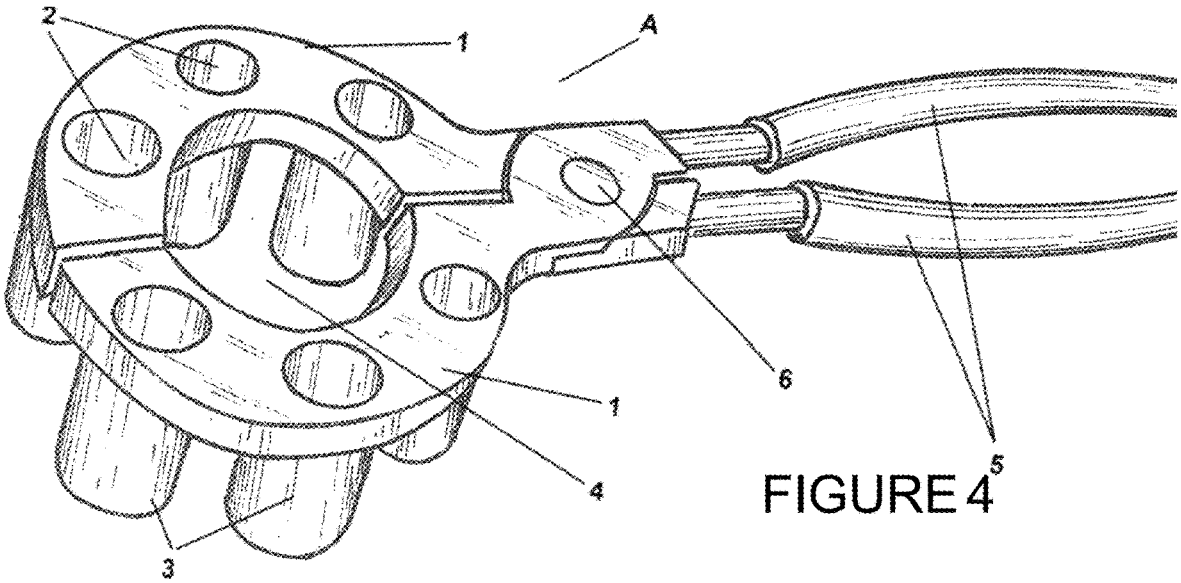
FIG. 4: shows the tool in rear and closed view.

FIGS. 1 to 4 show the tool (A) with a semicircular head (1) with three equidistant perimeter holes (2) and three tubular extensions on the same perimeter holes (3), a central hole in the tool when the semicircles join and form the circle (4), and the extension on the "clamp" type handles (5), joined by a bolt (6).

Figure 5:
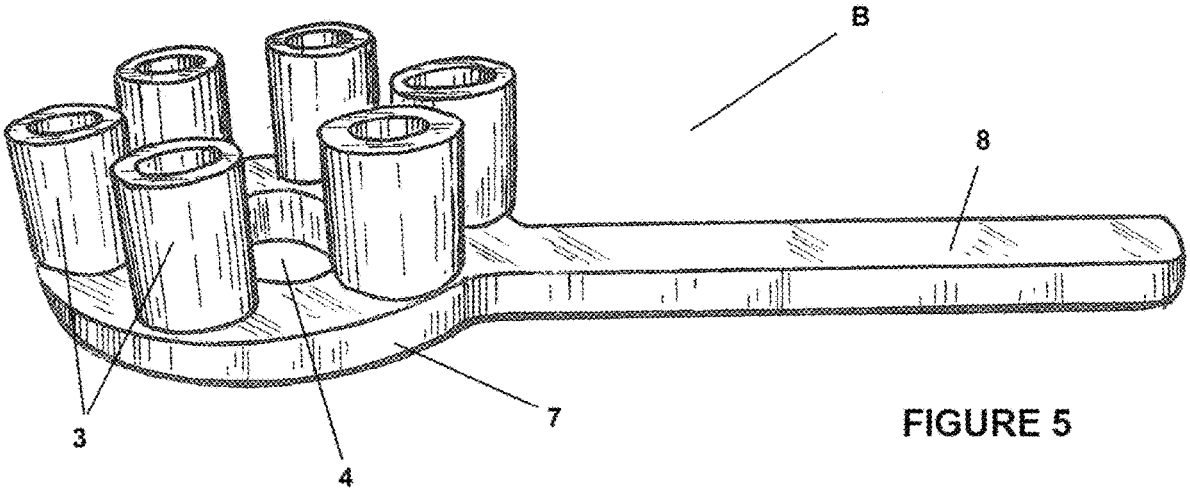
FIG. 5: shows an example of a "fixed wrench" type resolution in front perspective.
Figure 6A:
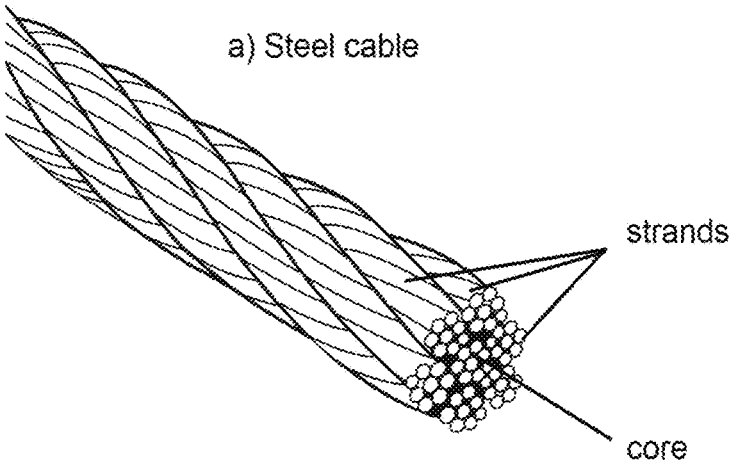
FIG. 6A an explanatory illustration A showing a steel cable.
Figure 6B:
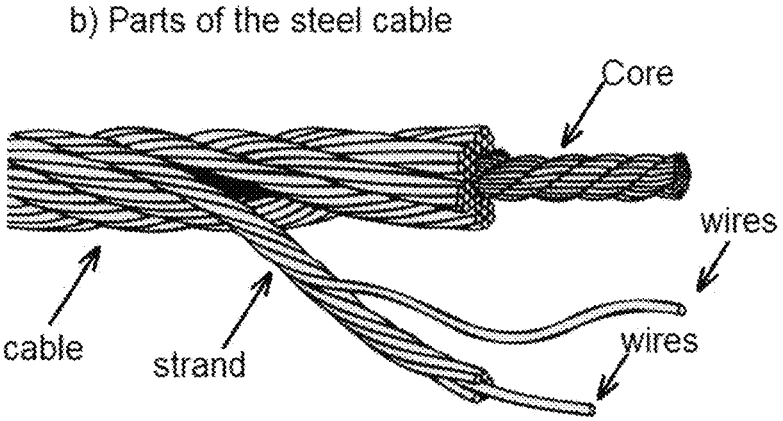
FIG. 6B shows parts of the steel cable of FIG. 6A.
Figure 6C:
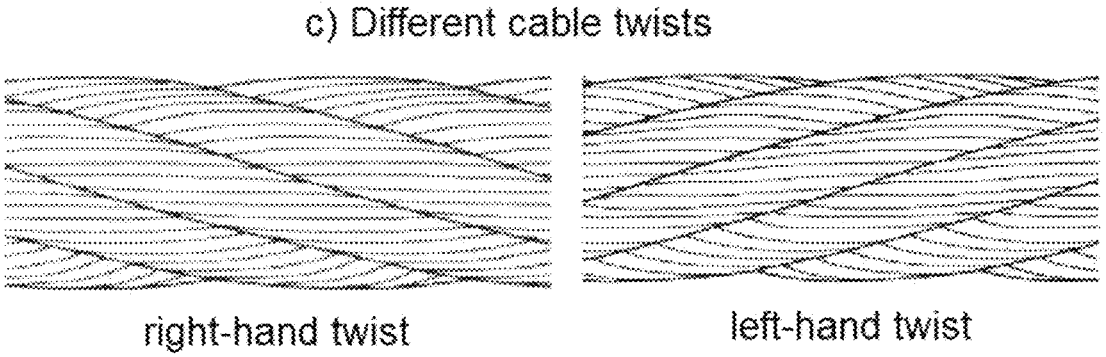
FIG. 6C shows two different types of cable twist.
Figure 12A:
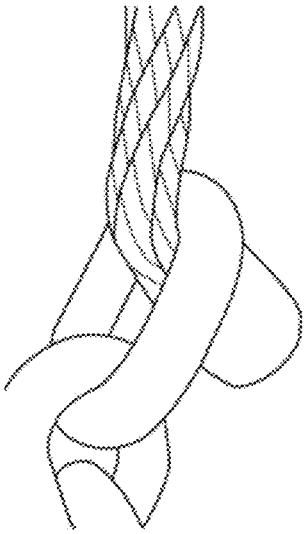
FIG. 12*a* shows an explanatory illustration D showing a first eyelet of the chain threaded into the cable by the hook.
Figure 12B:
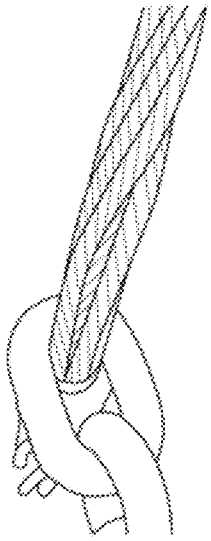
FIG. 12B shows another view of the first link locked in the socket and braked.
Figure 13:
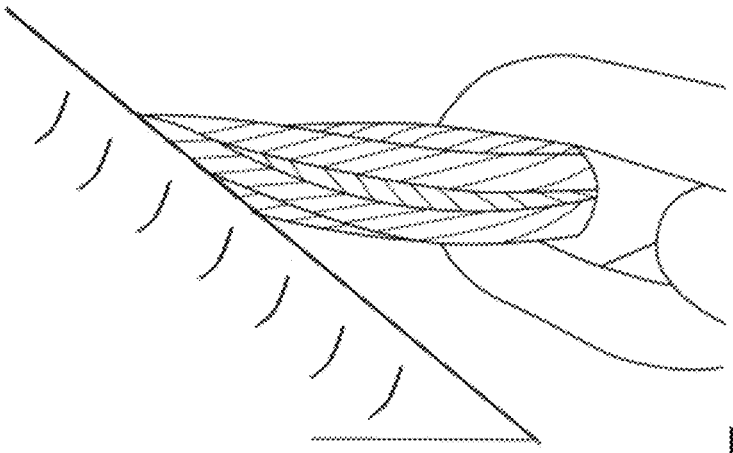
FIG. 13 shows a sling locked by the socket.
Figure 14A:
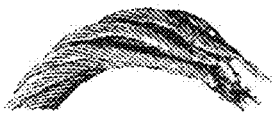
FIG. 14A shows an explanatory illustration E showing a bending or crushing breakage.
Figure 14B:
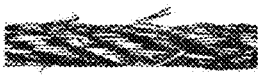
FIG. 14B shows wire cuts due to wear or corrosion.
Figure 14C:
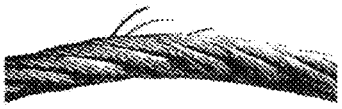
FIG. 14C shows another wire cuts due to wear or corrosion.
Figure 14D:
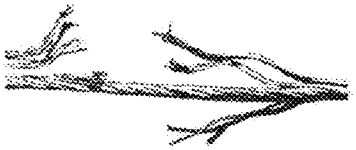
FIG. 14D shoes cuts due to overstress and/or overload.
Figure 15A:
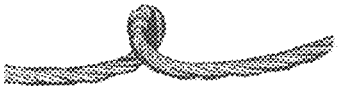
FIG. 15A shows a stage of assembly of a coke or irremediable curl.
Figure 15B:
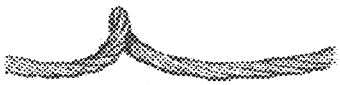
FIG. 15B shows another stage of assembly of a coke or irremediable curl.
Figure 15C:
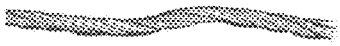
FIG. 15C shows another stage of assembly of a coke or irremediable curl.
Figure 16A:
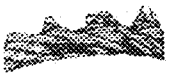
FIG. 16A shows an example of deformation.
Figure 16B:
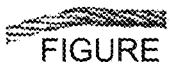
FIG. 16B shows another example of deformation.
Figure 16C:
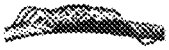
FIG. 16C shows another example of deformation.
Figure 17A:
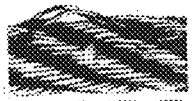
FIG. 17A shows another example of deformation.
Figure 17B:
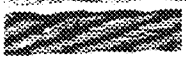
FIG. 17B shows another example of deformation.
Figure 17C:
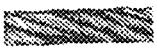
FIG. 17C shows another example of deformation.

While in FIG. 5, we see the "fixed wrench" type tool (B), with a full circle head (7) with a central hole (4) and six equidistant perimeter holes provided with tubular extensions (3), and a fixed handle (8).

The Proposed Tool

The tool (A) created by the inventors consists of two parts that together form a clamp with a very particular structure and design. Each part, symmetrical to the other, is made of steel with an open semicircular head (1) which extends into a handle (5). This flattened semicircular head has three equidistant holes (2) which each extend into a tubular housing (3) perpendicular to the semicircular plane, so that each semicircle has three holes with its three tubular extensions on the same side; the two parts of the clamp are joined by a bolt in a hole in the handles (6), forming a complete clamp that opens and closes by separating or joining the semicircular heads with their tubular extensions, and which, when kept closed, has a central circular opening (4). See FIGS. 1 to 4.

The tubular extension in the perimeter holes has been proposed on one side only, i.e.: from the flat semicircular head with its three holes the tubular extensions emerge on one side only, leaving the other side of the semicircular head free and flat. In such a way that the complete and closed tool presents on one side six perimeter holes and a central one, and on the other side six perimeter hollow tubes and a central opening. The difference in the use of one side or the other will provide a utilitarian advantage as described below.

A different embodiment (B), based on the same functional principle, is also foreseen: transforming the "plier" style into the "fixed wrench" style, in such a way that the tool is made of steel, consisting of a flattened circular annular head (7), with a central hole (4) and six equidistant perimeter holes (2), from which circular annular body emerge perimetrically six tubular extensions (3) perpendicular to the circular annular body and as an extension of each perimetral hole (2) and, said flattened circular annular head (7) extends into a handle (8) of the same material and which allows its manipulation. See FIG. 5.

Description of how to Use the Tool

First the operator attaches the end of the cable on which he will assemble the load assembly (chain sling and socket with wedges) preferably in a vise, leaving a sufficiently long section free to work on it.

He will pass the first link of the sling chain through the cable, and immediately afterwards pass the socket steel tube, after which he will separate the six strands slightly with ordinary pliers, leaving the ends of the strands sufficiently open to pass them through the holes (2) of the tool here shown, inserting each of the six strands into each of the holes in the circular perimeter of the tool head, and pass through the open space or central hole of the tool (4) the steel core of the cable; This allows the cable to be held in place and can be manually rotated to either side; the operator will turn it in the opposite direction to the winding of the cable, allowing the strands to be separated and the tool will allow him to maintain the strand separation stable and equidistant and even between each strand, so that the placement of the wedges is symmetrical and avoids the risk of inadequately arming the cable, having achieved the necessary free space between the strands, manually insert the new bronze wedges that will press the cable against the inner wall of the socket, and once the wedges are in place, turn the cable again in the direction of its winding to adjust it as far as possible, verifying that the wedges have been evenly placed and that the strands are pressed against the inner wall of the socket; the tails of the strands will always remain outside the socket, together with the tool, which can now be removed without effort.

When the tool is removed and the tips of the stranded strands are visible outside the socket, these tips will maintain a certain even separation between them due to the pressure exerted by the bronze wedges inside the socket against the walls of the socket, the assembly being restrained in such a way as to prevent the cable from slipping during loading operations.

A particular explanation deserves the way to insert the strands of the cable in the tool according to whether it is done from the mouth of the tubular extensions (3) or from the holes on the flat side of the tool (2), the choice will depend on the type of cable and if it is new and more flexible or used and hardened, therefore it has been proposed the tubular extension in the perimeter holes on one side of the tool, so that, for the new cable you can use the tool placing it with the tubes upwards and inserting the strands in the perimeter holes of the head base, since it will be easier to twist to open the strands due to the greater flexibility of the cable; while for the cable used it will be convenient to insert the strands through the holes of the tubes, being the tool with the tubes downwards, and this will allow a greater separation of the strands and an easier manipulation in the task of opening and closing them, the tubular extension that takes the strands lower down allows a better manipulation for the work to be done. The inventors have tried the construction of a tool with tubular extensions towards both sides finding that it did not bring any additional advantage, whereas this way of tubular extension towards only one side gives the advantage of the option of use from one side or the other as explained.

Thanks to this tool, the operator can keep the cable stable, separate the strands, to safely insert the bronze wedges and also push them calmly into place against the inner walls of the socket. Remember that this work, until now, has been done manually, requiring more than one assistant operator to try not to close the strands against the fingers of the operator who places the wedges, often using inadequate tools such as chisels or screwdrivers to insert between the strands, with risks of injuries and accidental jumping of said implements, to which is added the difficulty of having to return the cable to its original winding manually, all of which ends in unavoidable imperfections and subsequent new damages or risks of disassembly, all of which is alleviated thanks to the present invention.

Having described the nature of the proposed tool, its conformation, its variant and the way of use thereof, the following is claimed as of exclusive right of the inventors:

The invention claimed is:

1. A manual tool for expanding and manipulating steel cables, the manual tool comprising;

a first flat steel pieces including a first semicircular head and three equidistant circular perforations and a tubular extension protruding from each one of three equidistant circular perforations, each one of the tubular extensions protrude perpendicular from the second flat steel piece;

a second flat steel piece including a second semicircular head and three equidistant circular perforations and a tubular extension protruding from each one of three equidistant circular perforations, each one of the tubular extensions protrude perpendicular from the second flat steel piece;

wherein the first and the second flat steel piece are connected by a bolt, wherein when the first and second flat steel piece in a closed position forms a circle;

wherein the first and the second flat steel piece extend in handles;

wherein the manual tool is adapted to be used with the steel cable having a steel core and six strands of coiled metal wires wrapping said steel core.

2. The manual tool according to claim 1, wherein each one of the tubular projections of the first and the second flat steel piece has size and thickness equal to a size a thickness of the strands of the steel cable to be manipulated.

3. The manual tool according to claim 1, wherein the manual tool includes one piece flat steel head having circular annular head with a central hole and six equidistant circular perforations, a tubular extension protruding from each of the six equidistant circular perforations, wherein each one of the tubular extensions protrude perpendicular from the one piece flat steel head and a handle extending from the circular annular head.

4. A manual tool for expanding and manipulating steel cables, the manual tool consisting of:

a first flat steel piece including a first semicircular head and three equidistant circular perforations and a tubular extension protruding from each one of three equidistant circular perforations, each one of the tubular extensions protrude perpendicular from the first flat steel piece;

a second flat steel piece including a second semicircular head and three equidistant circular perforations and a tubular extension protruding from each one of three equidistant circular perforations, each one of the tubular extensions protrude perpendicular from the second flat steel piece;

wherein the first and the second flat steel piece are connected by a bolt, wherein when the first and the second flat steel piece in a closed position forms a circle;

wherein the first and the second flat steel piece extend into handles;

wherein the manual tool is adapted to be used with the steel cable having a steel core and six strands of coiled metal wires wrapping said steel core.

* * * * *